US005800133A

United States Patent [19]

Ikeda et al.

[11] Patent Number: 5,800,133

[45] Date of Patent: Sep. 1, 1998

[54] COMPRESSOR WITH DISCHARGE CHAMBER RELIEF VALVE

[75] Inventors: Hayato Ikeda; Hitoshi Inukai; Kazuhito Kawasumi; Hideo Mori; Koichi Ito; Naoya Yokomachi, all of Kariya, Japan

[73] Assignee: Kabushiki Kaisha Toyoda Jidoshokki Seisakusho, Japan

[21] Appl. No.: 730,485

[22] Filed: Oct. 11, 1996

[30] Foreign Application Priority Data

Oct. 12, 1995 [JP] Japan ..... 7-264516
Feb. 1, 1996 [JP] Japan ..... 8-016758

[51] Int. Cl.[6] ..... F04B 1/12

[52] U.S. Cl. ..... 417/269; 417/440; 417/312; 137/543.17

[58] Field of Search ..... 251/367; 137/543.17, 137/543.19; 417/307, 269, 222.1, 222.2, 312, 440

[56] References Cited

U.S. PATENT DOCUMENTS

| | | | |
|---|---|---|---|
| 2,812,893 | 11/1957 | Cotter | 417/307 |
| 4,049,017 | 9/1977 | Jones | 137/543.17 |
| 4,105,370 | 8/1978 | Brucken et al. | 417/269 |
| 4,522,568 | 6/1985 | Gelse et al. | 417/307 |
| 4,665,943 | 5/1987 | Medvick et al. | 137/543.17 |
| 4,759,691 | 7/1988 | Morse | 417/307 |
| 5,094,145 | 3/1992 | Wakabayashi et al. | 417/307 |
| 5,112,198 | 5/1992 | Skinner | 417/269 |
| 5,173,042 | 12/1992 | Chambers | 137/543.19 |
| 5,577,894 | 11/1996 | Kawaguchi et al. | 417/222.2 |

FOREIGN PATENT DOCUMENTS

| | | |
|---|---|---|
| 62-114189 | 7/1987 | Japan . |
| 8-105381 | 4/1996 | Japan . |

*Primary Examiner*—Timothy Thorpe
*Assistant Examiner*—Peter G. Korytnyk
*Attorney, Agent, or Firm*—Woodcock Washburn Kurtz Mackiewicz & Norris LLP

[57] ABSTRACT

A compressor has a compression chamber and a discharge region. The discharge region receives the compressed gas discharged from the compression chamber. A relief valve is mounted to inside of the wall in the discharge region. The relief valve connects the discharge region with the exterior of the compressor so as to discharge the excessively raised pressure in the discharge region.

10 Claims, 7 Drawing Sheets

COMPRESSOR WITH DISCHARGE CHAMBER RELIEF VALVE

BACKGROUND OF THE INVENTION

1. Field of the Invention

The present invention relates to compressors, and more particularly to variable displacement compressors used in vehicle air conditioners, which have a relief valve for adjusting discharge pressure 2. Description of the Related Art In an piston-type compressor, refrigerant gas is first drawn into a suction chamber from an external refrigerant circuit. The gas is then compressed by piston reciprocation in cylinder bores. The compressed gas is discharged to the outside of the compressor through a discharge chamber. Accordingly, the pressure inside the discharge chamber is increased by the gas. For preventing excessive pressure in the discharge chamber, relief valve structure is widely adopted for letting the pressure in the discharge chamber escape to the outside of the compressor.

FIG. 9 shows a conventional compressor having a relief valve for adjusting discharge pressure. The compressor includes a cylinder block 61 and a discharge muffler 62 provided on the upper portion of the cylinder block 61. The discharge muffler 62 is communicated with a discharge chamber defined in a front housing 63 and a rear housing (not shown). A relief valve 64 is coupled to the muffler 62 and extends through its side wall. The valve 64 has a pressure receiving port located in the muffler 62. The relief valve 64 is opened to relieve the gas pressure in the muffler 62 when it exceeds a predetermined value and becomes abnormally high.

However, the relief valve 64, which protrudes outwardly from the discharge muffler 62, enlarges the outer dimensions of the compressor. The protruding valve 64 also increases the weight of the compressor. Furthermore, the valve 64 is coupled to the muffler 62 from the outer side. This structure reduces the strength of the valve with respect to the pressure in the muffler 62. In order to increase the strength of the valve 64 to resist the discharge pressure, the valve 64 needs to be firmly coupled to the muffler 62. Thus, it is necessary to employ rigid coupling means such as threads formed on the valve 64 and in the port to screw the valve to the muffler. This results in a relatively complicated coupling structure, which requires high accuracy. The manufacturing cost of the compressor is thus increased.

SUMMARY OF THE INVENTION

Accordingly, it is an objective of the present invention to provide a compressor that is compact and light.

Another objective of the present invention is to provide a compressor that is easy to assemble and requires low manufacturing cost.

Yet another objective of the present invention is to provided a relief valve that is firmly coupled to a chamber wall without requiring an accurate machining of the wall.

To achieve the above objectives, an improved compressor is proposed. The compressor has a shell that forms a wall of the compressor, a compression chamber that is defined in the shell to compress the gas and a discharge region that is defined in the shell to receive the compressed gas discharged from the compression chamber. The discharge region is separated from the exterior by the wall. A relief valve is mounted to inside of the wall in the discharge region. The relief valve is capable of connecting the discharge region with the exterior of the compressor.

According to another aspect of the present invention, a relief valve is mounted to a wall of a chamber to discharge excessively raised pressure from the chamber. The chamber is separated from the exterior by the wall. The relief valve has a large diameter portion located close to the chamber, a small diameter portion located closed to the exterior and a pressure passage connected with the chamber and extending along a substantially entire length of the large diameter portion and the small diameter portion. The pressure passage has a bore that communicates with the exterior.

According to yet another aspect of the present invention, a relief valve is fitted in a wall which divides a high pressure region and a low pressure region to discharge pressure from the high pressure region to the low pressure region. The relief valve has a valve housing which includes a large diameter portion close to the high pressure region and a small diameter portion close to the low pressure region. A step portion is formed between the large diameter portion and the small diameter portion to hold the valve housing within the wall against the pressure that urges the valve housing toward the low pressure region from the high pressure region.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A swash plate type compressor according to a first embodiment of the present invention will be described below with reference to FIGS. 1 to 3.

Figure 1:
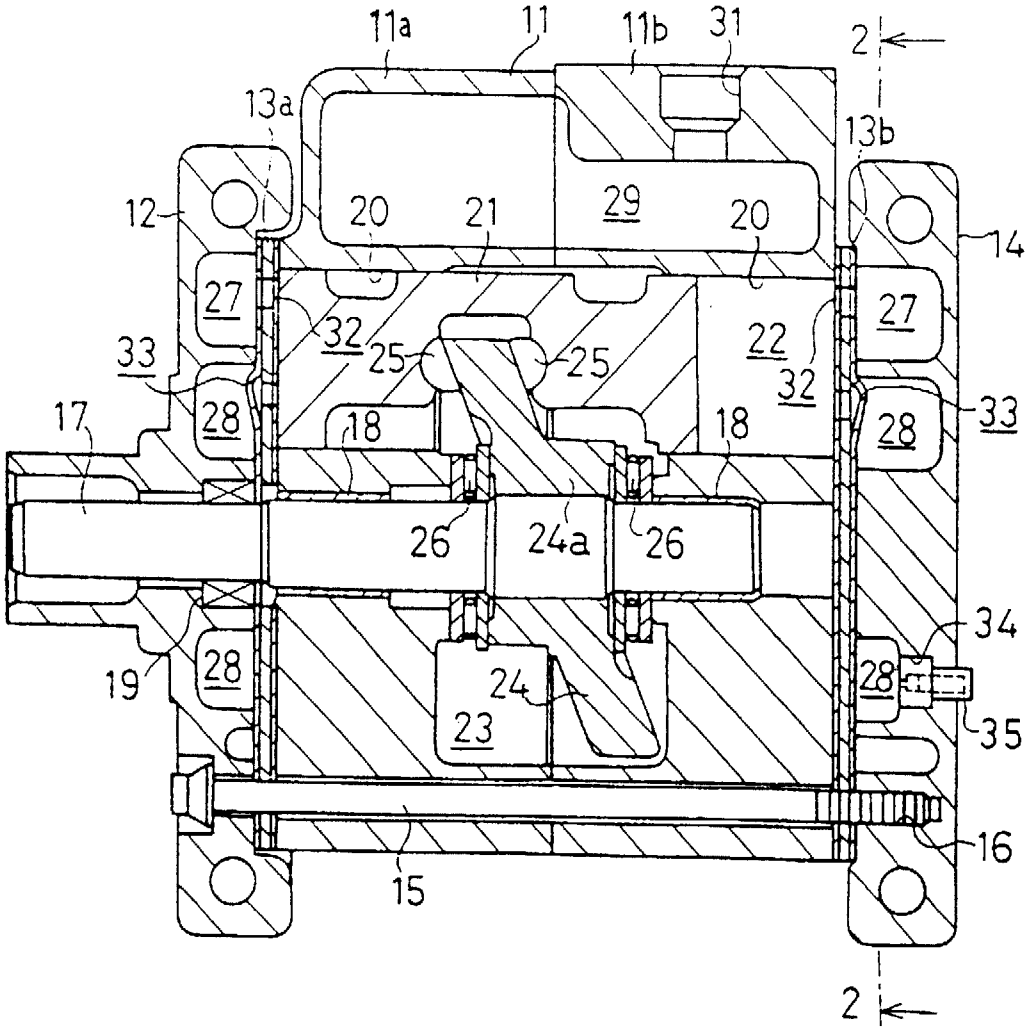
FIG. 1 is a cross-sectional view illustrating a compressor according to a first embodiment of the present invention.

As shown in FIG. 1, a pair of cylinder blocks 11*a* and 11*b* are secured to each other at their ends. The pair of cylinder blocks 11*a* and 11*b* constitute a main housing 11.

A front housing 12 is secured to the front end face of the main housing 11 with a valve plate 13*a* provided in between. A rear housing 14 is secured to the rear end face of the main housing 11 with another valve plate 13*b* provided in between.

A plurality of bolts 15, which extend through the front housing 12, the main housing 11 and the valve plates 13*a* and 13*b*, are screwed into screw holes 16 formed in the rear housing 14. The bolts 15 clamp and fix the front housing 12 and the rear housing 14 to the front end face and the rear end face of the main housing 11, respectively.

A rotary shaft 17 is rotatably supported by a pair of radial bearings 18 and extends through the center of the main housing 11 and the front housing 12. A lip seal 19 is located between the rotary shaft 17 and the front housing 12. The rotary shaft 17 is connected to and rotated by an external drive source such as an engine (not shown).

A plurality of cylinder bores 20 are formed extending through the main housing 11 about the rotary shaft 17. The bores 20 are arranged parallel to the rotary shaft 17 with a predetermined interval between each adjacent bore 20. A double-headed piston 21 is housed in each bore 20. In each cylinder bore 20 compression chambers 22 are defined between the both of the front and end faces of the associated piston 21 and the associated valve plates 13*a* and 13*b*. The volume of each compression chamber 22 changes according to the position of the associated piston 21. The front end face of the piston 21 contacts the valve plate 13*a* in FIG. 1. This temporarily eliminates the front compression chamber 22. Therefore, only the rear compression chamber 22 is shown in FIG. 1.

A crank chamber 23 is defined in the main housing 11. A swash plate 24 is fixed to the rotary shaft 17 in the crank chamber 23 and coupled to the longitudinally middle part of each piston 21 by a pair of semispherical shoes 25. The swash plate 24 rotates integrally with the rotary shaft 17. The rotating movement of the swash plate 24 is transmitted to each piston 28 through the shoes 25 and converted to a linear reciprocating movement of each piston 21 in the associated cylinder bore 20. A thrust bearing 26 is located between the inner wall surface of each cylinder block and a boss 24*a* of the swash plate 24. The thrust bearings 26 hold the swash plate 24 between the cylinder blocks 11*a* and 11*b*.

Figure 2:
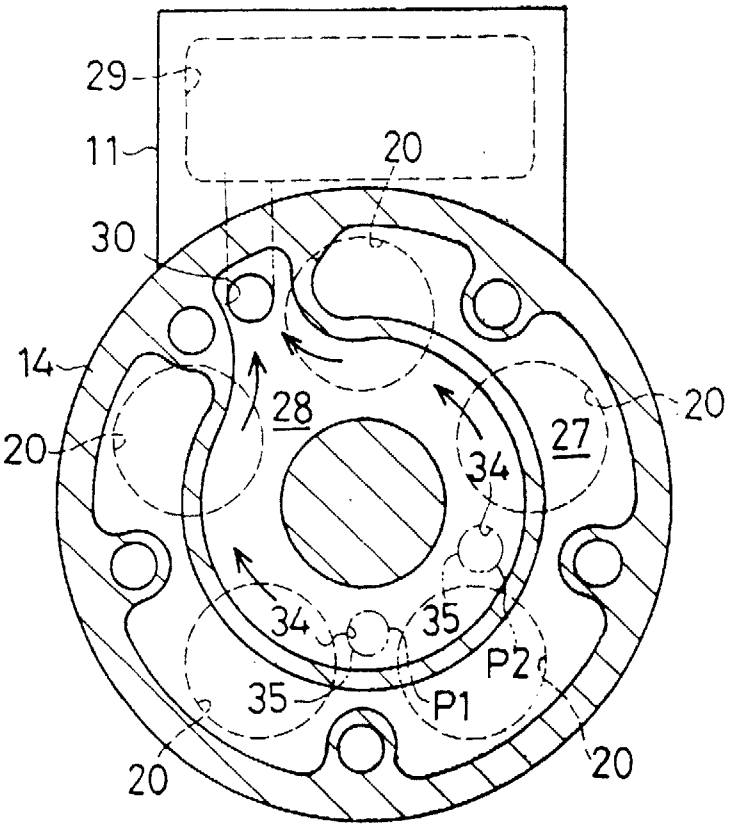
FIG. 2 is a cross-sectional view taken along line 2—2 of FIG. 1.

As shown in FIGS. 1 and 2, annular suction chambers 27 are defined in the peripheral section of the front and rear housings 12 and 14. Each suction chamber 27 is connected to an external refrigerant circuit (not shown) via a suction port (not shown). Annular discharge chambers 28 are defined at the inner side of the suction chamber 27 in the front and rear housings 12 and 14. A discharge muffler 29 is provided on the top portion of the main housing 11 and is connected to the discharge chamber 28 via a discharge passage 30, as shown in FIG. 2. As shown in FIG. 1, a discharge duct 31 is formed in the top portion of the discharge muffler 29 to connect the muffler 29 to the external refrigerant circuit. The front and rear discharge chambers 28 are connected to each other via the discharge muffler 29 and a pair of front and rear discharge passages (not shown).

Each of valve plates 13*a* and 13*b* has a suction valve mechanism 32. Refrigerant gas is drawn into the compression chamber 22 defined in each cylinder bore 20 through the suction chamber 27 by the suction valve mechanism 32. Each valve plate 13 also has a discharge valve mechanism 33. After compression, refrigerant gas is discharged to the discharge chambers 28 from the compression chamber 22 in each cylinder bore 20 by means of the discharge valve mechanism 33.

Figure 3:
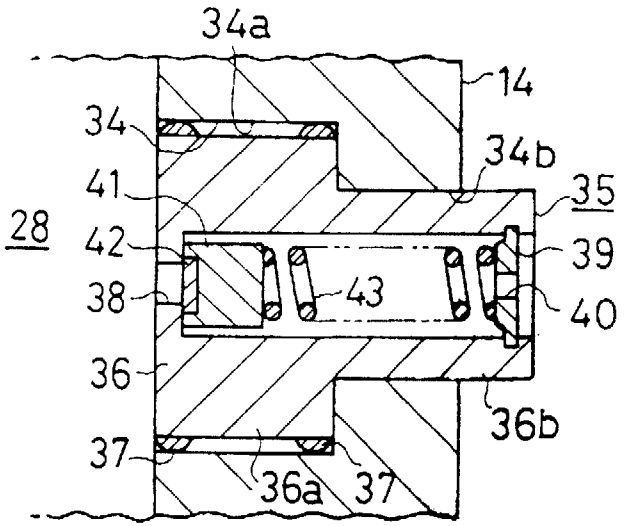
FIG. 3 is an enlarged partial cross-sectional view illustrating the attachment structure of the relief valve shown in FIG. 1.

As shown in FIGS. 1 to 3, a hole 34 is formed extending parallel to the rotary shaft 17 in the rear housing 14. The hole 34 communicates the discharge chamber 28 with the outside of the compressor. The hole 34 has a large diameter portion 34*a* connected to the discharge chamber 28 and a small diameter portion 34*b* connected to the outside of the compressor. The hole 34 is located next to the cylinder bore 20 that is farthest from a discharge passage 30. That is, it occupies either position P1 or P2 shown by the double-dashed lines in FIG. 2.

A valve housing 36 of a relief valve 35 is fitted in the 34 from the inside of the rear housing 14. The valve housing 36 has a substantially cylindrical shape with one end opened to the outside of the rear housing 14. The valve housing 36 also has a large diameter portion 36*a* fitted in the large diameter portion 34*a* of the hole 34 and a small diameter portion 36*b* fitted in the small diameter portion 34*b*. The small diameter portion 36*b* protrudes from the rear housing 14. The valve housing 36 is formed from a metal material such as aluminum through forging. The peripheral surface of the housing is finished through grinding. The relief valve 35 may be formed by machining a cylindrical or cylindrical column metal material.

A pair of rubber seal rings 37 are welded to the large diameter portion 36*a* of the valve housing 36. The valve housing 36 comes into contact with the seal rings 37 when fitted in the hole 34 and seals the hole 34. A pressure receiving port 38 is provided in the inner end of the valve housing 36 and is connected with the discharge chamber 28. A spring seat 39 is arranged in the outer end of the valve housing 36. A pressure releasing port 40 is defined in the center of the seat 39. The releasing port 40 is connected with the outside of the rear housing 14.

As shown in FIGS. 1 and 3, most of the valve housing 36 of the relief valve 35 is fitted within the wall of the rear housing 14 with a part protruding a little from the outer surface of the rear housing 14. Therefore, the flow of refrigerant gas is not obstructed by the relief valve 35 located at a point P1 or P2 discharged into the discharge chamber 28 from the cylinder bore 20 and drawn into the discharge passage 30. This ensures smooth gas flow and an effective cooling operation of the compressor. Further, unlike the conventional compressor, the relief valve 35 protrudes little from the discharge muffler 29 or the rear housing 14. This reduces the size and weight of the compressor.

A valve body 41 of the relief valve 35 is supported movably in the valve housing 36. A rubber contact 42 is fitted in the inner end of the valve body 41. The contact 42 contacts the outer end of the pressure receiving port 38. A spring 43 is provided between the valve body 41 and the spring seat 39. The spring 43 biases the valve body 41 inwardly. Under normal conditions, as shown in FIG. 3, a passage defined in the valve housing 36 between the pressure receiving port 38 and the pressure releasing port 40 is closed by the contact 42 being pressed against the opening of the pressure receiving port 38. When the compressor is operated, the valve body 41 is moved against the force of the spring 43 if the gas pressure in the discharge chamber 28 exceeds a predetermined value and becomes abnormally high. This opens the pressure receiving port 38, thereby forming a passage in the valve housing 36 extending between the pressure receiving port 38 to the pressure releasing port 40. The refrigerant gas in the discharge chamber 28 is discharged to the outside of the compressor through the formed passage. This reduces the gas pressure in the discharge chamber 28. Accordingly, the pressure in the compressor is prevented from becoming any higher.

In the above swash plate compressor, the rotary shaft 17 is rotated by an external drive source such as an engine (not shown). Rotation of the swash plate 24, which is rotated integrally with the shaft 17, is converted to linear reciprocation of each piston 21 in the corresponding cylinder bore 20. The reciprocation of the piston 21 draws refrigerant gas into the compression chamber 22 of each cylinder bore 20 from the suction chambers 27 via the suction valve mechanism 32. The gas is compressed in the chamber 22. The compressed gas is then discharged into the discharge chambers 28 from the suction chamber 22 of each cylinder bore 20 via the discharge valve mechanism 33.

When the compressor is operated, the gas pressure in the discharge chamber 28 presses the release valve 35 engaged in the rear housing from the inside toward the outside of the compressor. At this time, the step formed by the large diameter portion **36*a* and the small diameter portion 36*b* restricts the outward movement of the valve 35, thereby retaining the valve 35 in the rear housing 14. In other words, the discharge pressure functions to strengthen the fixation of the relief valve 35. This eliminates a necessity for a screw or the like to fix the relief valve 35 to the housing 14 and allows the valve 35 to be retained at a fixed position by the internal pressure of the discharge chamber 28 with the seal rings 37 placed between the relief valve and the inner wall of the hole 34. Accordingly, a process requiring a high accuracy for retaining the valve 35**, such as threading, is omitted. This simplifies the manufacturing of the compressor and reduces the manufacturing cost.

Attaching a relief valve from the outside of the rear housing 14 would require, as described above, a fastener such as threads formed on the engaging members. In such case, the relief valve would require a hexagonal head so that it may be screwed into the housing 14 from the outside by a tool. In order to reduce the protruding margin of the hexagonal head from the outer surface of the rear housing 14, a circular recess that receives the head should be formed in the rear housing 14. Additional thickness of the wall of the housing 14 is necessary to allow formation of such a circular recess. This may reduce the discharge chamber volume. The present invention does not necessitate circular recess. Therefore, according to the present invention, the structure of the rear housing 14 is simpler and ensures a predetermined discharge chamber volume.

Further, according to the present invention, the relief valve 35 is secured by the small sealing in the limited space in the discharge chamber 28. Therefore, the relief valve 35 and its attachment structure do not enlarge the rear housing 14. Accordingly, the predetermined discharge chamber volume of the rear housing 14 is ensured.

When a relief valve is attached to the rear housing 14 from the outside as described above, the space between the pressure receiving port 38 and the valve plate 13 opposed to the port 38 is narrow. This narrow space acts to resist the flow of refrigerant gas and may delay the response of the relief valve when the internal pressure of the compressor becomes abnormally high.

In contrast, sufficient space between the pressure receiving port 38 of the relief valve 35 and the valve plates **13*a* and 13*b* opposed to the port 38 is ensured in the present invention. Therefore, abnormally high gas pressure in the discharge chamber 28 is smoothly released into the pressure receiving port 38 of the relief valve 35. Accordingly, the relief valve 35** opens without any delay and relieves the abnormally high gas pressure.

Figure 5:
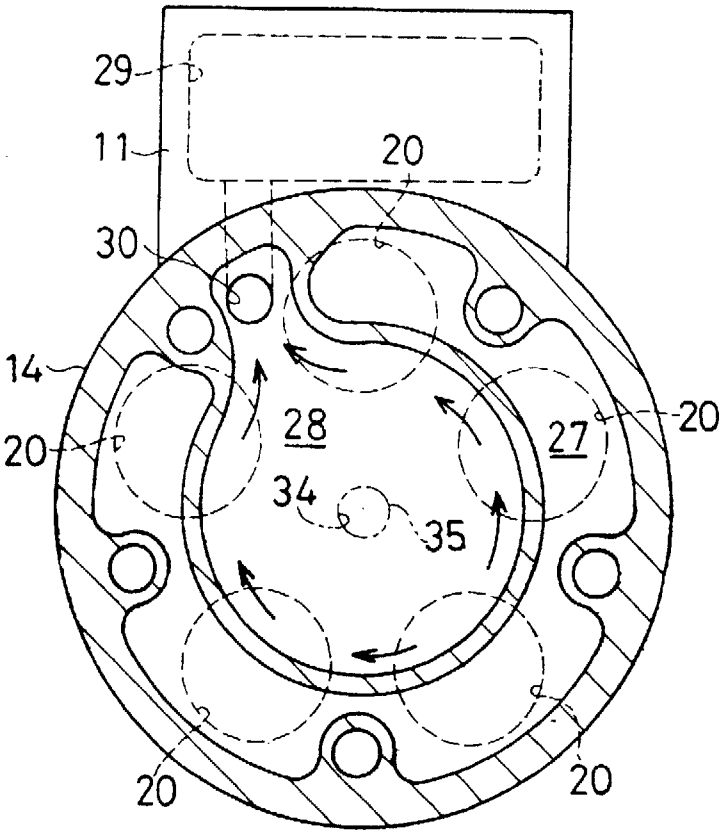
FIG. 5 is a cross-sectional view taken along line 5—5 of FIG. 4.
Figure 4:
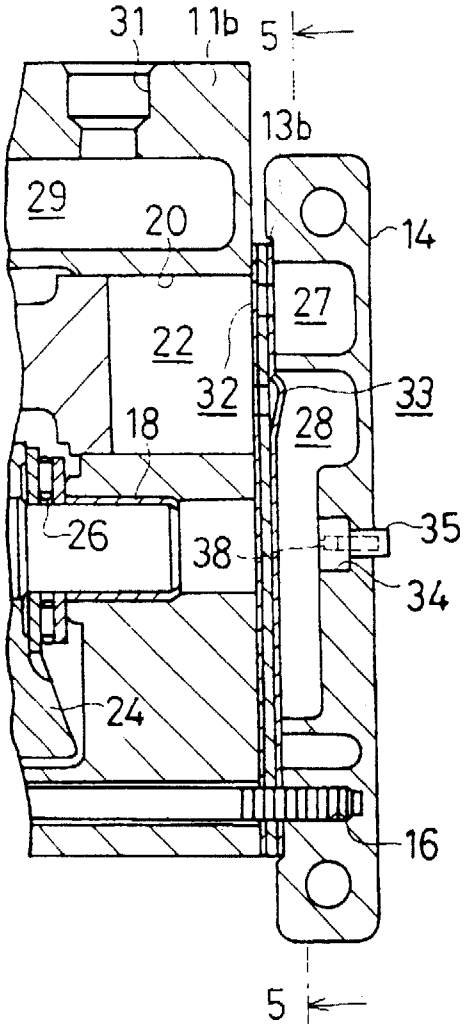
FIG. 4 is a partial cross-sectional view illustrating a compressor according to a second embodiment of the present invention.

A second embodiment of the present invention will now be described with reference to FIGS. 4 to 6.

In the second embodiment, a hole 34 is formed near the center of the discharge chamber 28 in the rear housing 14. As shown in FIG. 6A, corresponding annular grooves 45, 46 are defined in the inner wall of a large diameter portion **34*a* of the hole 34 and in the peripheral surface of the large diameter portion 36*a* of the valve housing 36, respectively. The annular grooves 45, 46 are aligned with each other when the valve housing 36 is fitted in the hole 34. An annular space is defined in the aligned grooves 45, 46. A seal ring 47 is accommodated in the space formed by the grooves 45 and 46**.

Figure 6B:
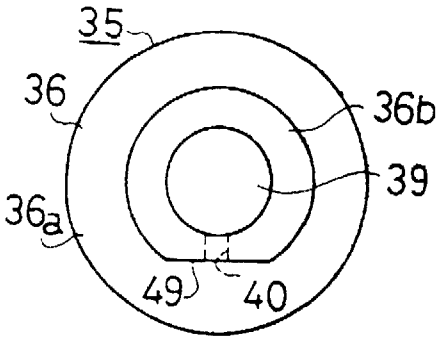
FIG. 6B is an enlarged side view illustrating the relief valve of FIG. 6A.
Figure 6A:
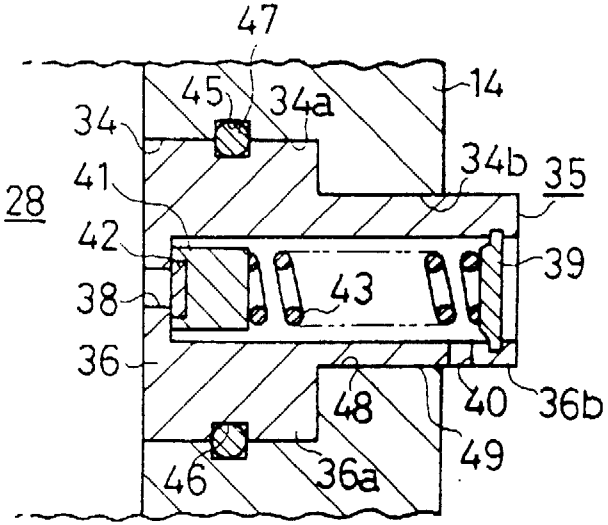
FIG. 6A is an enlarged partial cross-sectional view illustrating the attachment structure of the relief valve shown in FIG. 4.

Further, in this embodiment, as shown in FIG. 6B, a flat part 48 is defined at the bottom inner wall of the small diameter portion **34*b* of the hole 34. The valve housing 36 also has a flat part 49 defined at the bottom periphery of the small diameter portion 36*b*. The flat parts 48 and 49 are aligned with each other when the valve housing 36 is fitted in the hole 34. A pressure releasing port 40 is formed in the flat part 49. Gas pressure is relieved through the port 40 in the outer periphery of the valve housing 36. The engagement of the flat portions 48 and 49 serves as a positioner to prevent the valve housing 36 from rotating in the hole 34. This retains the port 40 in a fixed position. This restricts the direction of escaping gas to a downward direction as viewed in FIG. 6A. The released gas therefore can be directed away from peripheral devices placed near the rear housing. Accordingly, the peripheral devices are not polluted or broken by the released gas. Further, this structure requires no additional parts to prevent the rotation of the valve 35**. Accordingly, the number of parts in the compressor is reduced.

Oil mist is included in the refrigerant gas. The oil mist lubricates the inside of the compressor. In this embodiment, the high pressure gas from the discharge chamber 28 does not flow straight in the housing 36, but is discharged from the pressure releasing port 40 formed in the periphery of the small diameter portion **36*b*. This allows the gas to stay in the relief valve 35** longer, and therefore prevents the oil mist in the gas from leaking. A failed lubrication in the compressor is thus prevented.

The relief valve 35 is provided near the center of the discharge chamber 28 in the rear housing 14. Refrigerant gas, which is discharged from each cylinder bore 20 into the discharge chamber 28 and drawn into the discharge passage 30, flows along the periphery of the discharge chamber 28 as indicated by the arrows in FIG. 5. The flow of refrigerant gas in the chamber 28 is not blocked by the relief valve 35. This enables the gas to flow smoothly and contributes to efficient cooling.

In the small diameter portion **36*b* of the valve housing 36, as long as it is directed away from peripheral devices, the pressure releasing port 40 may be formed on other part than the flat part 49**.

A third embodiment of the present invention will be described with reference to FIG. 7.

Figure 7B:
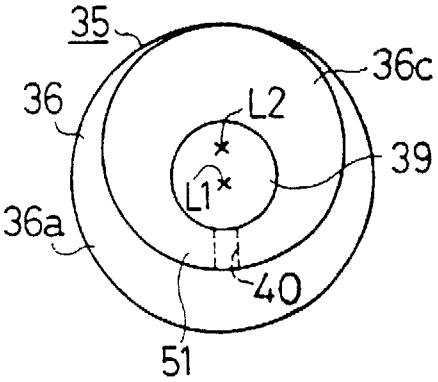
FIG. 7B is an enlarged side view illustrating the relief valve shown in FIG. 7A.
Figure 7A:
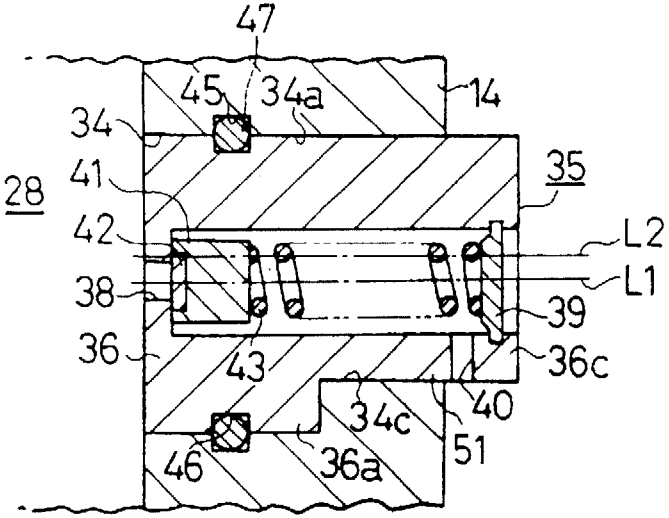
FIG. 7A is an enlarged partial cross-sectional view illustrating a compressor according to a third embodiment of the present invention.

As shown in FIGS. 7A and 7B, the valve housing 36 of the relief valve 35 is formed to fit in the hole 34 formed in the rear housing 14. The hole 34 consists of a large diameter portion **34*a*, the center line of which is an axis L1, and a small diameter portion 34c, the center line of which is an eccentric axis L2. The valve housing 36 consists of a large diameter portion 36a, the center line of which is the axis L1, and a small diameter portion 36c, the center line of which is the eccentric axis L2. The common eccentric axis L2 is offset from the common axis L1 by a predetermined distance. Near the outer end of the small diameter portion 36c, the pressure releasing port 40 is defined extending perpendicular to the axis L1 in a thin portion 51 defined at the bottom of the small diameter portion 36c as viewed in FIG. 7B. The small diameter portion 34c and the eccentric small diameter portion 36c function as a positoner and position the valve 35. The positioner prevents the valve housing 36 from rotating in the hole 34 and restricts the direction of gas emitted from the pressure releasing port 40 to a predetermined direction. This positioner of the valve housing 36 is formed by forging the valve housing 36 and then finish grinding the cylindrical surface. Accordingly, manufacturing of the valve housing 36 is relatively simple. Further, as in the second embodiment, the positioner eliminates the necessity for additional parts to prevent the rotation of the valve 35**. This prevents the increase in the number of parts in the compressor.

As long as it is directed away from peripheral devices, the pressure releasing port 40 may be formed on other part than the thin portion 49.

A fourth embodiment of the present invention will be described with reference to FIG. 8.

Figure 8B:
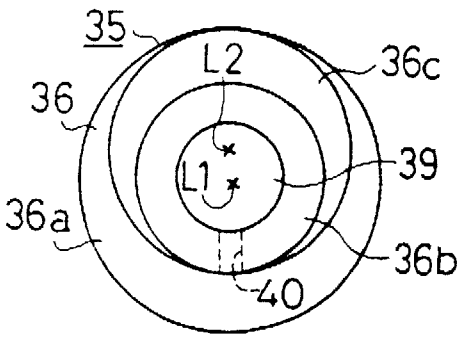
FIG. 8B is an enlarged side view illustrating the relief valve shown in FIG. 8A.
Figure 8A:
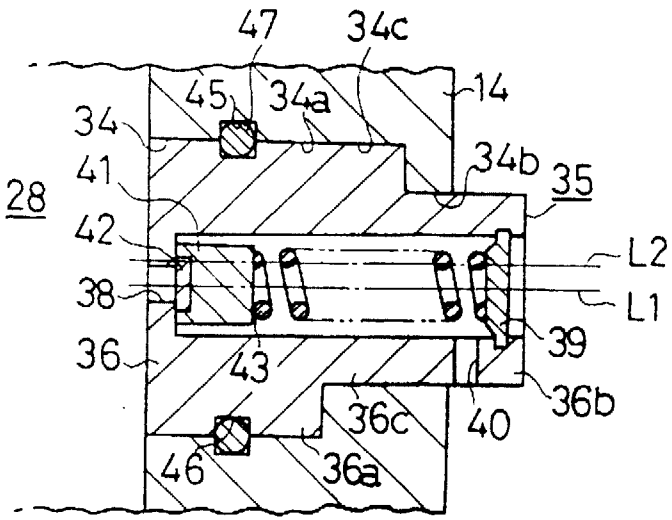
FIG. 8A is an enlarged partial cross-sectional view illustrating a compressor according to a fourth embodiment of the present invention.
Figure 9:
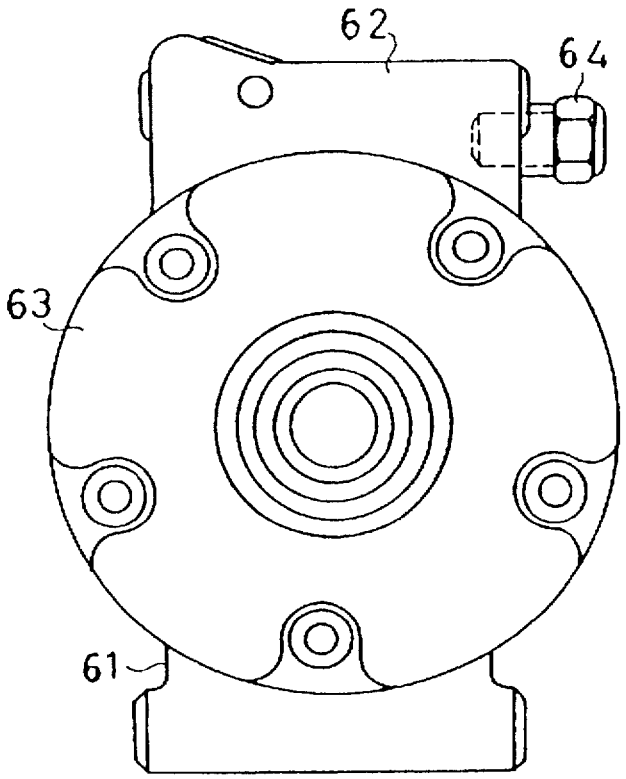
FIG. 9 (Prior Art)
FIG. 9 is a side view illustrating a prior art compressor.

As shown in FIGS. 8A and 8B, an eccentric small diameter portion 34c is formed between the large diameter portion 34a and the small diameter portion 34b of the hole 34 in the rear housing 14. The relief valve 35 has an eccentric small diameter portion 36c between the large diameter portion 36a and the small diameter portion 36b such that the valve 35 may be fitted in the hole 34. A pressure releasing port 40 is formed near the outer end of the small diameter portion 36b extending downward as viewed in FIG. 8B. The port 40 extends perpendicular to the axis L1.

The fourth embodiment has the same advantages as the third embodiment.

Therefore, the present examples and embodiments are to be considered as illustrative and not restrictive and the invention is not to be limited to the details given herein, but may be modified within the scope of the appended claims.

What is claimed is:

1. A compressor for compressing gas introduced therein from an external circuit and discharging therefrom to an exterior of the compressor, said compressor comprising:

a compressor housing having a thickness;

a compression chamber defined in the housing to compress the gas;

a discharge region defined in the housing to receive the compressed gas discharged from the compression chamber, said discharge region being separated from the exterior by a wall of the housing; and a relief valve mounted to the inside of the discharge region, said relief valve having a length substantially equal to the thickness of the housing near a location where said relief valve is mounted and being capable of connecting the discharge region with the exterior of the compressor, wherein said relief valve includes a first portion located close to the discharge region, a second portion located close to the exterior, said second portion having a diameter smaller than that of the first portion, a pressure passage connected with the discharge region and extending in a substantially entire length of the first portion and the second portion, and said pressure passage having a bore communicating with the exterior of the compressor.

2. The compressor as set forth in claim 1, further comprising positioning means for regulating a rotation of the relief valve in the wall.

3. The compressor as set forth in claim 2, wherein said positioning means includes a flat outer surface provided with the second portion.

4. The compressor as set forth in claim 2, wherein said positioning means includes an entire range of the second portion eccentrically formed with respect to the first portion.

5. The compressor as set forth in claim 2, wherein said first portion and the second portion are formed concentrically formed to each other, wherein said positioning means includes a third portion formed between the first portion and the second portion and eccentric with respect to the first portion and the second portion, and wherein said third portion has diameter larger than that of the second portion and smaller than that of the first portion.

6. The compressor as set forth in claim 1, wherein said bore extends perpendicularly to pressure passage.

7. The compressor as set forth in claim 1, wherein said discharge region includes a discharge chamber for discharging the compressed gas.

8. The compressor as set forth in claim 7, wherein said discharge region further includes a discharging muffler communicating with the discharge chamber.

9. A compressor for compressing gas introduced therein from an external circuit and discharging therefrom to an exterior of the compressor, said compressor comprising:

a compressor housing;

a compression chamber defined in the housing to compress the gas;

a discharge region defined in the housing to receive the compressed gas discharged from the compression chamber, said discharge region being separated from the exterior by a wall of the housing, the wall being provided with a hole which comprises a large diameter hole and a small diameter hole; and a relief valve mounted to inside of the wall in the discharge region, said relief valve being capable of connecting the discharge region with the exterior of the compressor, wherein said relief valve includes a first portion located close to discharge region, a second portion located close to the exterior, said second portion having a diameter smaller than that of the first portion, the first portions and the second portions being substantially fitted in the large diameter hole and the small diameter hole of the wall, respectively, a pressure passage connected with the discharge region and extending in a substantially entire length of the first portion and the second portion, said pressure passage having a bore communicating with exterior of the compressor.

10. The compressor as set forth in claim 9, further comprising:

said housing having a thickness; and said relief valve having a length substantially equal to the thickness of the housing at the location where it is mounted.

* * * * *